US009541239B2

(12) United States Patent
Scordino et al.

(10) Patent No.: US 9,541,239 B2
(45) Date of Patent: Jan. 10, 2017

(54) LIGHTING DEVICE AND CORRESPONDING METHOD OF ASSEMBLY

(71) Applicant: Osram GmbH, Munich (DE)

(72) Inventors: Alessandro Scordino, Dolo (IT); Franco Zanon, Cassola (IT)

(73) Assignee: OSRAM GmbH, Munich (DE)

( * ) Notice: Subject to any disclaimer, the term of this patent is extended or adjusted under 35 U.S.C. 154(b) by 145 days.

(21) Appl. No.: 14/338,362

(22) Filed: Jul. 23, 2014

(65) Prior Publication Data

US 2015/0029735 A1 Jan. 29, 2015

(30) Foreign Application Priority Data

Jul. 23, 2013 (IT) ..... TO2013A0623

(51) Int. Cl.

| | |
|---|---|
| ***F21V 15/04*** | (2006.01) |
| ***F21K 99/00*** | (2016.01) |
| ***F21V 31/00*** | (2006.01) |
| ***F21V 29/70*** | (2015.01) |
| *F21Y 101/00* | (2016.01) |

(52) U.S. Cl.

CPC . *F21K 9/30* (2013.01); *F21K 9/20* (2016.08); *F21V 29/70* (2015.01); *F21V 31/005* (2013.01); *F21Y 2101/00* (2013.01); *Y10T 29/49826* (2015.01)

(58) Field of Classification Search

CPC ..... F21K 9/30; F21V 31/005; F21V 15/04; F21V 17/101; F21V 19/005; F21Y 2101/02

See application file for complete search history.

(56) References Cited

U.S. PATENT DOCUMENTS

| | | | | |
|---|---|---|---|---|
| 5,327,330 | A | 7/1994 | Van Oel et al. | |
| 7,175,325 | B2 * | 2/2007 | Otani | B29C 65/1635 362/519 |
| 7,633,055 | B2 * | 12/2009 | Nall | H05K 3/284 250/208.1 |
| 7,923,653 | B2 * | 4/2011 | Ohsumi | H01H 13/88 200/512 |
| 8,414,730 | B2 * | 4/2013 | Matsuura | B41J 2/471 156/272.2 |

(Continued)

FOREIGN PATENT DOCUMENTS

| | | | |
|---|---|---|---|
| CN | 101669187 | A | 3/2010 |
| DE | 202008004842 | A1 | 6/2008 |

(Continued)

OTHER PUBLICATIONS

Italian Search Report issued in IT TO20130623 dated Jan. 9, 2014.

(Continued)

*Primary Examiner* — Peggy Neils

(74) *Attorney, Agent, or Firm* — Viering, Jentschura & Partner mbB

(57) ABSTRACT

A lighting device includes a lighting source, e.g. a LED lighting source, arranged between a first and a second component with a coupling structure interposed between the first and the second component to sealingly couple them together.

The coupling structure includes at least one layer resiliently deformable to permit relative displacement of the first and second components.

7 Claims, 3 Drawing Sheets

(56) References Cited

U.S. PATENT DOCUMENTS

| | | | | |
|---|---|---|---|---|
| 9,175,814 | B2 * | 11/2015 | Shida | F21K 9/1355 |
| 2001/0040811 | A1 | 11/2001 | Chase et al. | |
| 2005/0024888 | A1 | 2/2005 | Otani et al. | |
| 2011/0260185 | A1 * | 10/2011 | Izutani | H01L 33/642 257/98 |
| 2012/0170248 | A1 * | 7/2012 | Masuko | F21K 9/00 362/95 |
| 2013/0314928 | A1 * | 11/2013 | Bittmann | F21K 9/135 362/363 |
| 2015/0204528 | A1 * | 7/2015 | Zeng | H05B 33/0803 362/363 |

FOREIGN PATENT DOCUMENTS

| | | | |
|---|---|---|---|
| DE | 202012100138 | U1 | 4/2013 |
| WO | 2008109813 | A2 | 9/2008 |
| WO | 2011137361 | A1 | 11/2011 |
| WO | 2013107705 | A2 | 7/2013 |

OTHER PUBLICATIONS

Chinese Office Action based on application No. 201410353195.8 (5 pages and 7 pages of English translation) dated Nov. 7, 2016 (Reference Purpose Only).

* cited by examiner

LIGHTING DEVICE AND CORRESPONDING METHOD OF ASSEMBLY

CROSS-REFERENCE TO RELATED APPLICATION

This application claims priority to Italian Patent Application Serial No. TO2013A000623, which was filed Jul. 23, 2013, and is incorporated herein by reference in its entirety.

TECHNICAL FIELD

Various embodiments relate to lighting devices.

Various embodiments may refer to solid-state lighting devices, such as LED lighting devices.

BACKGROUND

In integrating the structure of a solid-state lighting device, for example in general lighting applications, some requirements are to be met, e.g.:

- achieving steady and reliable protection conditions (for example as Ingress Protection, IP grade),
- offering a simple assembling and fixation process,
- efficiently adjusting the tolerances of the parts being assembled, also with reference to ambient conditions (e.g. in order to take into account the day-night temperature variations).

Various integrated solutions may employ, for example, rather complex mechanical connections and/or additional components/processes, such as for example screws (either self-threading or not), brackets, gaskets, additional mechanical fixation structures, that affect the overall performance due to the interaction of the various components.

Various solutions may create rather bulky and complex structures, which may affect the compactness of solid-state lighting sources (for example LED lighting sources) and which may not enable to reduce the complexity of the mounting system.

SUMMARY

The need is therefore felt of solutions adapted to overcome the above-mentioned drawbacks.

One or more embodiments aim at satisfying such requirements.

Various embodiments provide a lighting device.

Various embodiments further refer to a corresponding method.

Various embodiments may offer one or more of the following advantages:

- a high level of isolation (sealing) with the ability of absorbing mechanical tolerances,
- availability of a reliable and standardized coupling system with high levels of isolation (sealing) also as regards the ability of absorbing small displacements due to ambient conditions,
- stable fixation during the device lifetime, and protection against climatic and/or temperature variations.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

In the following description, numerous specific details are given to provide a thorough understanding of various exemplary embodiments. One or more embodiments may be practiced without one or more specific details, or with other methods, components, materials, etc. In other instances, well-known structures, materials, or operations are not shown or described in detail to avoid obscuring aspects of the embodiments. Reference throughout this specification to "one or more embodiments" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

The word "exemplary" is used herein to mean "serving as an example, instance, or illustration". Any embodiment or design described herein as "exemplary" is not necessarily to be construed as preferred or advantageous over other embodiments or designs.

The following description relates to one or more embodiments of a solid-state lighting device (module or system), e.g. a LED lighting device, wherein the general problem arises of mutually connecting (at least) two components A and B, made of the same material or of different materials.

One or more embodiments may involve the connection of said parts or components while providing a certain degree of protection against the intrusion of solid components ("Ingress Protection" or IP degree, according to the current terminology in the field).

The Figures refer to two components denoted in general by A and B, which generally represent two parts of a solid-state lighting device, e.g. a LED lighting device.

For merely exemplary and non-limiting purposes such a device, denoted on the whole by 100, may include a solid-state light radiation source L, which may be single or plural, e.g. comprising a LED array mounted on the base plate 12.

Figure 1:
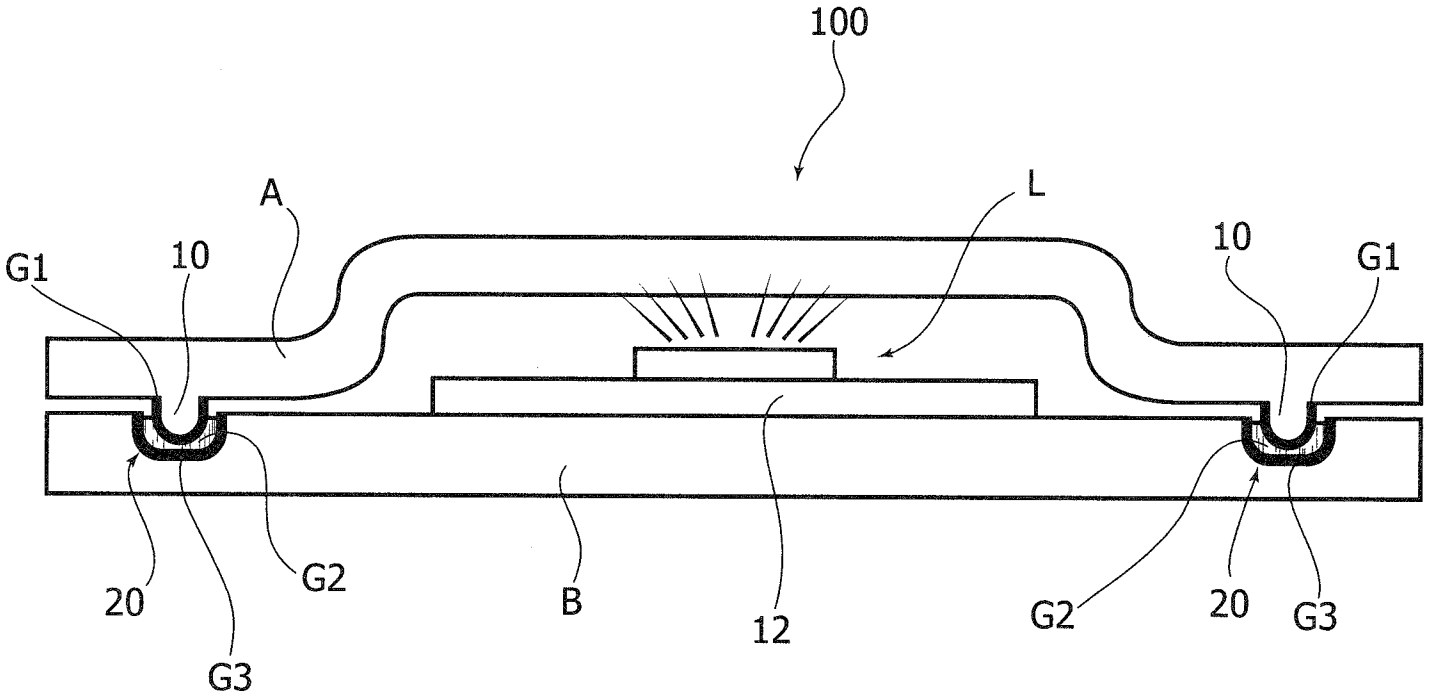
FIG. 1 schematically shows a lighting device according to embodiments.

As shown in FIG. 1, in one or more embodiments source L may then be applied onto a heat sink with a cover made of light-permeable (e.g. transparent) material, optionally with optical features (e.g. a lens).

One or more embodiments may therefore refer to a lighting device 100 adapted to house a lighting source L arranged between a first component A and a second component B.

In one or more embodiments, as exemplified herein, parts or components A and B to be mutually connected, while providing device 100 with a certain protection against the intrusion of solid components (e.g. IP degree) may be a cover (component A) and a heat sink (component B), which are mutually connected along corresponding facing edges surrounding source L.

In one or more embodiments, this may take place in the manners exemplified in FIGS. 2 to 7 wherein, for simplicity of illustration, there are shown in an ideal cross-section only said facing edges, denoted by A and B. It will therefore be assumed that, in one or more embodiments, the joining arrangements exemplified in FIGS. 2 to 7 are reproduced along the whole length of said facing edges surrounding source L (for example extending along a path which may be quadrangular, circular, elliptical, polygonal, mixtilinear, etc.).

In one or more embodiments, in order to ensure a protection for device 100 (for example an IP protection), a material may be used for sealingly coupling (e.g. fixing) components A and B.

In one or more embodiments, such a sealing coupling between parts A and B may comprise a sub-system made of different materials.

Figure 2:
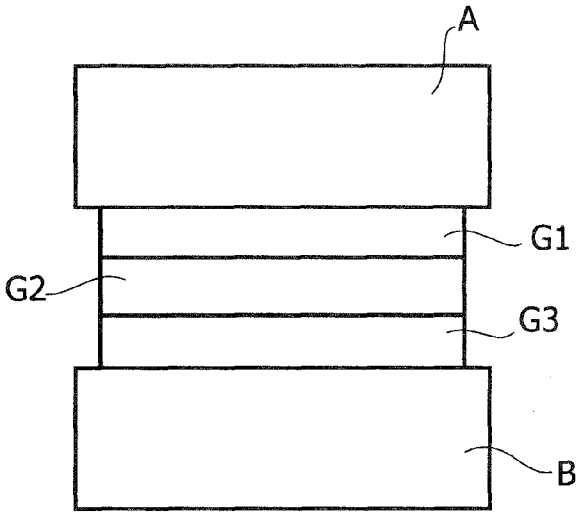
FIGS. 2 and 3 schematically show possible details of embodiments.

For example, FIG. 2 refers to possible embodiments wherein such a sub-system may be a layered structure including three materials G1, G2 and G3.

In one or more examples, material G1 may be a solid glue, material G2 may be an elastic glue and material G3 may be a solid glue (which may be the same as, or different from solid glue G1).

Figure 3:
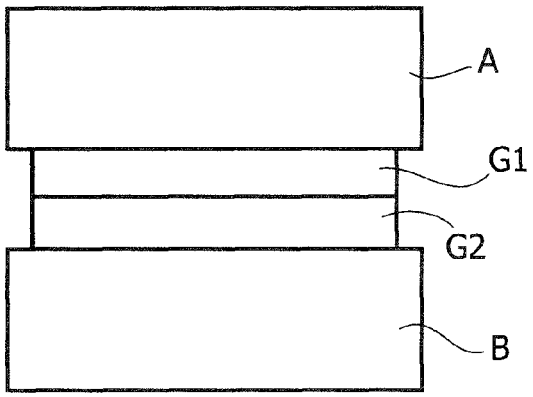

On the other hand, the diagram in FIG. 3 exemplifies embodiments wherein the layered structure includes two materials G1 and G2, which may consist for example in a solid glue and an elastic glue.

The presence in the layered structure G1, G2, G3 (FIG. 2) or G1, G2 (FIG. 3) of a component—i.e. a layer, for example glue G2—which is resiliently deformable enables, in one or more embodiments, to ensure a correct coupling (e.g. fixation) between components A and B, while ensuring a certain deformability (flexibility) of the assembly.

In one or more embodiments, the obtained device 100 is adapted to "change its shape" thanks to the elongation/the displacement of the mutual position of components A and B, due to the possible relative 3D movement (in the directions X, Y, Z), for example due to ambient conditions.

This may be true irrespective of whether the components are made of the same material or of different materials. This is made possible by the coupling (sealing) system which is adapted to resiliently (for example elastically) change its shape according to the various possible illustrated arrangements.

In one or more embodiments, the arrangement of three layers G1, G2, G3 in FIG. 2 may ensure a sealing between components A and B, while layer G2 (which in the illustrated example is sandwiched between layers G1 and G3) is able to absorb displacements in any direction X, Y, Z of component A with respect to component B (or vice versa; of course, the movement is relative), without losing the IP protection and without inducing tensions, stresses or damages into components A and B.

Similar statements may apply to the structure with two layers, G1 and G2, exemplified in FIG. 3, having layer G2 coupled to layer G1.

FIGS. 2 and 3 exemplify embodiments wherein the edges of mutually coupled components A and B have generally planar opposing faces (with the interposition of layers G1, G2 and, in the case of FIG. 3, G3).

Figure 4:
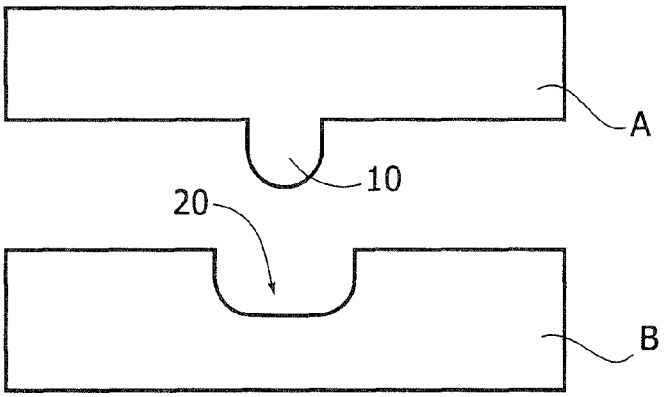
FIG. 4 shows a possible geometry of embodiments.

FIG. 4 and following exemplify one or more embodiments (relating to FIG. 1) wherein the opposing faces of components A and B may have a sculptured shape, with complementary structured portions, for example one or various reliefs 10 in either part (e.g. component A) entering into one or various cavities 20 provided in the other part (component B, in the illustrated examples).

Figure 5:
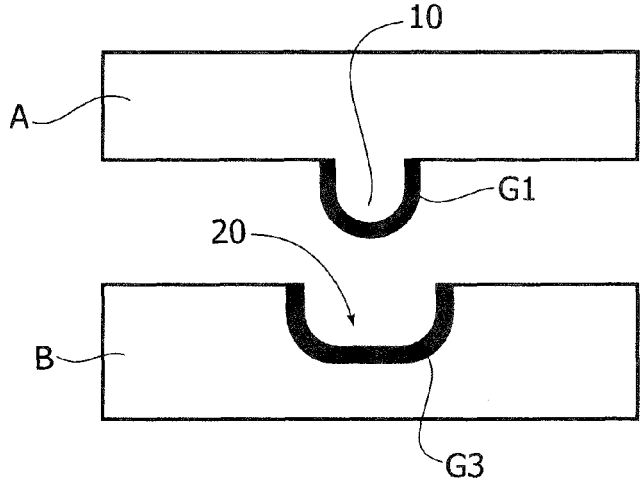
FIGS. 5 to 7 show various possibilities to implement embodiments.
Figure 6:
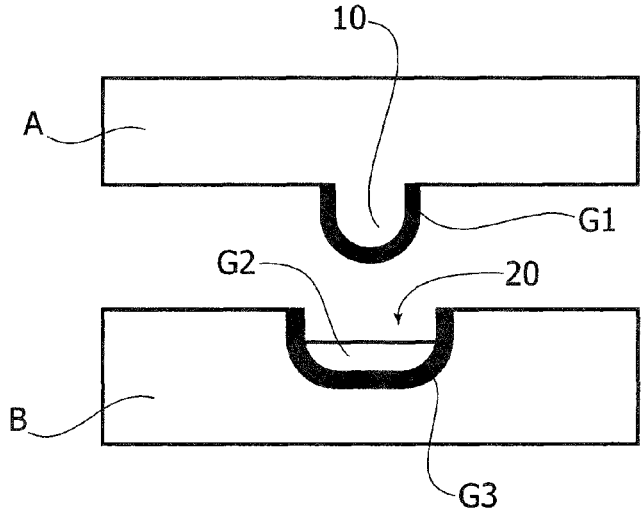
Figure 7:
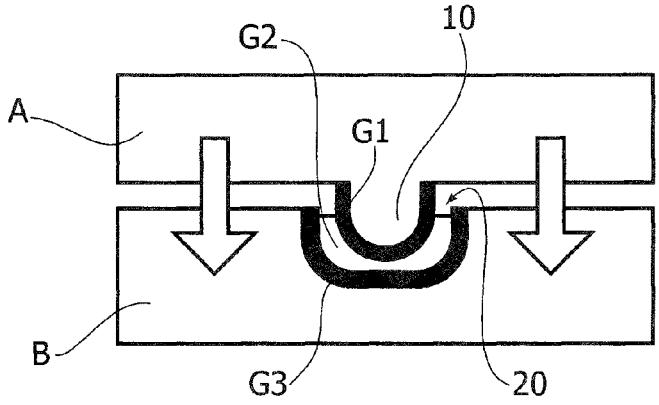

The sequence of FIGS. 5 to 7 (referring to components A and B having complementary sculptured portions 10, 20; however, the same criteria may also apply to parts A and B with planar opposing faces) exemplifies the possibility to apply layers G1 and G3 (e.g. glues) to components A and B (for example to relief 10 of component A and to cavity 20 of component B), and then to interpose layer G2 between them.

For example, this may take place by applying a "precursor" of layer G2 (in the case of a glue, such a precursor may the glue itself at a liquid or viscous state) onto material G3.

For example, in the presence of cavity 20, the precursor of layer G2 may be "cast" into cavity 20 already covered by layer G3.

The connection between parts A and B may then be achieved by pressing component A against component B, so that layer G2 takes on the desired final shape.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lighting device comprising a lighting source arranged between a first and a second component with a coupling structure interposed between the first and the second component to sealingly couple them together, wherein the coupling structure includes at least one layer resiliently deformable to permit relative displacement of the first and second components, wherein said coupling structure is a layered structure including said at least one resiliently deformable layer coupled with at least one other layer in said layered structure;

wherein said at least one resiliently deformable layer includes an elastic glue; and wherein said at least one other layer in said layered structure is a solid glue.

2. The lighting device of claim 1, wherein said at least one resiliently deformable layer of elastic glue is sandwiched between two other layers of solid glue in said layered coupling structure.

3. The lighting device of claim 1, wherein the first and second components have complementary sculptured portions with said layered coupling structure interposed between said complementary sculptured portions.

4. The lighting device of claim 1, wherein the first and the second components are a light permeable cover and a heat sink of the lighting device.

5. A method of assembling a lighting device comprising a lighting source arranged between a first and a second component, the method comprising:

interposing between said first and second components a coupling structure to sealingly couple the first and the second components together;

including in said coupling structure at least one layer resiliently deformable to permit relative displacement of the first and second components;

providing said at least one resiliently deformable layer as an elastic deformable layer; and providing said at least one resiliently deformable layer as an elastic glue;

wherein said coupling structure is a layered structure;

wherein said at least one resiliently deformable layer is coupled with at least one other layer in said layered structure; and wherein said at least one other layer in said layered structure is a solid glue.

6. The method of claim 5, further comprising:

providing in at least one of said first and second component a coupling portion in the form of a cavity, locating a precursor of said at least one resiliently deformable layer of elastic glue into said cavity, and assembling the first and second components together whereby said resiliently deformable layer of elastic glue is located therebetween.

7. The method of claim 5, including sandwiching said at least one resiliently deformable layer of elastic glue between two other layers of solid glue in said layered coupling structure.

* * * * *